US010961031B2

(12) United States Patent
Riedel et al.

(10) Patent No.: US 10,961,031 B2
(45) Date of Patent: Mar. 30, 2021

(54) CONTAINER ASSEMBLY WITH LOCKING CLOSURE

(71) Applicant: TARGET BRANDS, INC., Minneapolis, MN (US)

(72) Inventors: Richard P. Riedel, Blaine, MN (US); Terrence J. Hornsby, Jr., Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 210 days.

(21) Appl. No.: 16/231,763

(22) Filed: Dec. 24, 2018

(65) Prior Publication Data

US 2020/0198857 A1 Jun. 25, 2020

(51) Int. Cl.
*B65D 50/04* (2006.01)
*B65D 41/04* (2006.01)

(52) U.S. Cl.
CPC ..... *B65D 50/046* (2013.01); *B65D 41/04* (2013.01); *B65D 2215/02* (2013.01)

(58) Field of Classification Search
CPC .. B65D 50/046; B65D 41/04; B65D 2215/02; B65D 41/06; B65D 2251/04; B65D 2251/065; B65D 41/0471
USPC ..... 215/216
See application file for complete search history.

(56) References Cited

U.S. PATENT DOCUMENTS 1,612,449 A * 12/1926 Lee ..... B65D 41/0471 215/331
1,841,597 A * 1/1932 Hammer ..... B65D 41/0471 215/262
1,849,522 A * 3/1932 Hammer ..... B65D 41/0471 215/262
1,849,523 A * 3/1932 Hammer ..... B65D 41/0471 215/262
3,716,161 A 2/1973 Julian et al.
4,119,232 A * 10/1978 Thornton ..... B65D 41/06 215/222
4,346,809 A * 8/1982 Kusz ..... B65D 41/06 215/214

(Continued)

OTHER PUBLICATIONS

U.S. Appl. No. 29/589,933, filed Jan. 5, 2017 (59 pages).

(Continued)

*Primary Examiner* — Ernesto A Grano
(74) *Attorney, Agent, or Firm* — JoAnn M. Seaton; Griffiths & Seaton PLLC

(57) ABSTRACT

A container assembly comprising a container and a closure. The container includes a body defining a storage chamber and a neck. The neck extends away from the body and defines an open mouth providing access to the storage chamber. The neck further defines an exterior surface and at least two latching protrusions extending radially outwardly from the exterior surface. The closure includes a top wall, a cylindrical wall extending downwardly from the top wall, a first lug extending radially inwardly from the cylindrical wall, and a second lug extending radially inwardly from the cylindrical wall. A top surface of the first lug and a top surface of the second lug are each positioned a substantially identical distance away from the top wall and the first lug and the second lug are each configured to selectively lock with a common one of the at least two latching protrusions.

19 Claims, 14 Drawing Sheets

(56) References Cited

U.S. PATENT DOCUMENTS

| | | | | |
|---|---|---|---|---|
| 4,373,641 | A * | 2/1983 | Banich, Sr. | B65D 41/04 215/331 |
| 4,434,903 | A * | 3/1984 | Cooke | B65D 41/06 215/222 |
| 4,444,327 | A * | 4/1984 | Hedgewick | B65D 41/06 215/211 |
| 4,723,686 | A | 2/1988 | Pennisi | |
| 4,739,890 | A * | 4/1988 | Cooke | B65D 50/045 215/217 |
| 4,832,220 | A * | 5/1989 | Quennessen | B65D 41/0471 215/331 |
| 5,213,223 | A | 5/1993 | Minnette | |
| 5,443,175 | A * | 8/1995 | Kelly | B65D 17/506 220/298 |
| 5,449,077 | A | 9/1995 | Seidler | |
| 5,449,078 | A * | 9/1995 | Akers | B65D 41/06 215/222 |
| 5,662,233 | A * | 9/1997 | Reid | B65D 41/58 215/273 |
| 5,829,609 | A * | 11/1998 | Beck | B65D 50/048 215/217 |
| 5,927,532 | A | 7/1999 | Traub | |
| 6,378,713 | B2 | 4/2002 | Montgomery | |
| 6,739,466 | B1 | 5/2004 | Culley | |
| 7,165,692 | B2 | 1/2007 | Konefal et al. | |
| 7,387,214 | B1 | 6/2008 | Shingle | |
| 7,673,763 | B1 | 3/2010 | Oh | |
| 7,819,265 | B2 * | 10/2010 | Brozell | B65D 41/065 215/222 |
| 8,079,483 | B2 | 12/2011 | Brozell et al. | |
| 8,240,491 | B2 | 8/2012 | Beecroft et al. | |
| 8,424,695 | B2 | 4/2013 | Buono | |
| 8,616,407 | B2 | 12/2013 | Sawicki | |
| 8,701,921 | B2 | 4/2014 | Acedo Morono | |
| 8,857,638 | B2 | 10/2014 | Brozell | |
| 8,870,004 | B2 | 10/2014 | McCoy et al. | |
| 9,527,619 | B2 * | 12/2016 | Patel | C08F 2/50 |
| 9,763,853 | B2 * | 9/2017 | Miceli | B65D 50/046 |
| 2005/0145629 | A1 | 7/2005 | Herr | |
| 2007/0062900 | A1 * | 3/2007 | Manera | B65D 41/06 215/222 |
| 2010/0038279 | A1 * | 2/2010 | Estep | B65D 21/0231 206/534 |
| 2011/0056948 | A1 | 3/2011 | Brennan | |
| 2012/0261378 | A1 * | 10/2012 | Acedo | B65D 41/06 215/216 |
| 2015/0329232 | A1 * | 11/2015 | Brozell | B65D 41/0471 215/44 |
| 2017/0001763 | A1 | 1/2017 | Hu | |
| 2019/0144176 | A1 * | 5/2019 | Yourist | B65D 41/36 215/217 |
| 2019/0241330 | A1 * | 8/2019 | Stoneberg | B65D 53/04 |

OTHER PUBLICATIONS

U.S. Appl. No. 29/671,283, filed Nov. 26, 2018 (44 pages).
U.S. Appl. No. 29/589,931, filed Jan. 5, 2017 (58 pages).
U.S. Appl. No. 29/663,861, filed Sep. 19, 2018 (44 pages).
U.S. Appl. No. 29/589,929, filed Jan. 5, 2017 (95 pages).
U.S. Appl. No. 29/668,938, filed Nov. 2, 2018 (49 pages).
U.S. Appl. No. 29/589,930, filed Jan. 5, 2017 (95 pages).
U.S. Appl. No. 29/672,898, filed Dec. 10, 2018 (49 pages).

* cited by examiner

CONTAINER ASSEMBLY WITH LOCKING CLOSURE

BACKGROUND OF THE INVENTION

Many container assemblies include selective closures to maintain a cover on a container, and therefore, to maintain items within the container during periods of storage. Container assemblies are often configured with a selectively locking closure to allow a user to unlock the container to access the contents of the container and to lock the container to protect the contents within the container from undesired dispensing. In one example, such container assemblies are configured to be unlocked by adults, but to be difficult to unlock by children, for example, containers with child-resistant closures, especially in the case of container assemblies holding medication or other substances not suitable for unmetered access by children. Conventional container assemblies with locking enclosures often become difficult to access by intended users, especially users of advanced age and/or having disabilities.

SUMMARY

A container assembly according to the present invention includes a container and a closure. The container includes a body defining a storage chamber and a neck. The neck extends away from the body and defines an open mouth providing access to the storage chamber. The neck further defines an exterior surface and at least two latching protrusions extending radially outwardly from the exterior surface. The closure includes a top wall, a cylindrical wall extending downwardly from the top wall, a first lug extending radially inwardly from the cylindrical wall, and a second lug extending radially inwardly from the cylindrical wall. A top surface of the first lug and a top surface of the second lug are each positioned a substantially identical distance away from the top wall and the first lug and the second lug are each configured to selectively lock with a common one of the at least two latching protrusions. Other containers, closures, assemblies, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

This innovation provides a container assembly with locking closure configured to be grasped and selectively locked and unlocked for opening. In one embodiment, the container assembly is characterized by having at least two, in one example, only two latching interactions between the container and the closure around a neck of the closure and/or utilizing at least about a 60° rotation, and in one embodiment, at least about an 80° rotation, of the closure relative to the container to lock and unlock the closure to or from the container. In one example, each latching interaction includes an elongated rail leading to a ramp and latching recess of the container as well as a latching lug and a balance lug extending radially inwardly from a cylindrical wall of the closure. When attaching or removing the closure from the container, both the latching lug and the balance lug interface with a bottom surface of the elongated rail and the latching lug interfaces with the substantially colinear bottom surface of a stop in a manner providing a stable closure-to-container coupling with little undesired closure tilt facilitating alignment and closure, while requiring a signification degree of turn to remain at least partially child resistant. These and other embodiments, methods, assemblies, and advantages are described below.

Figure 1:
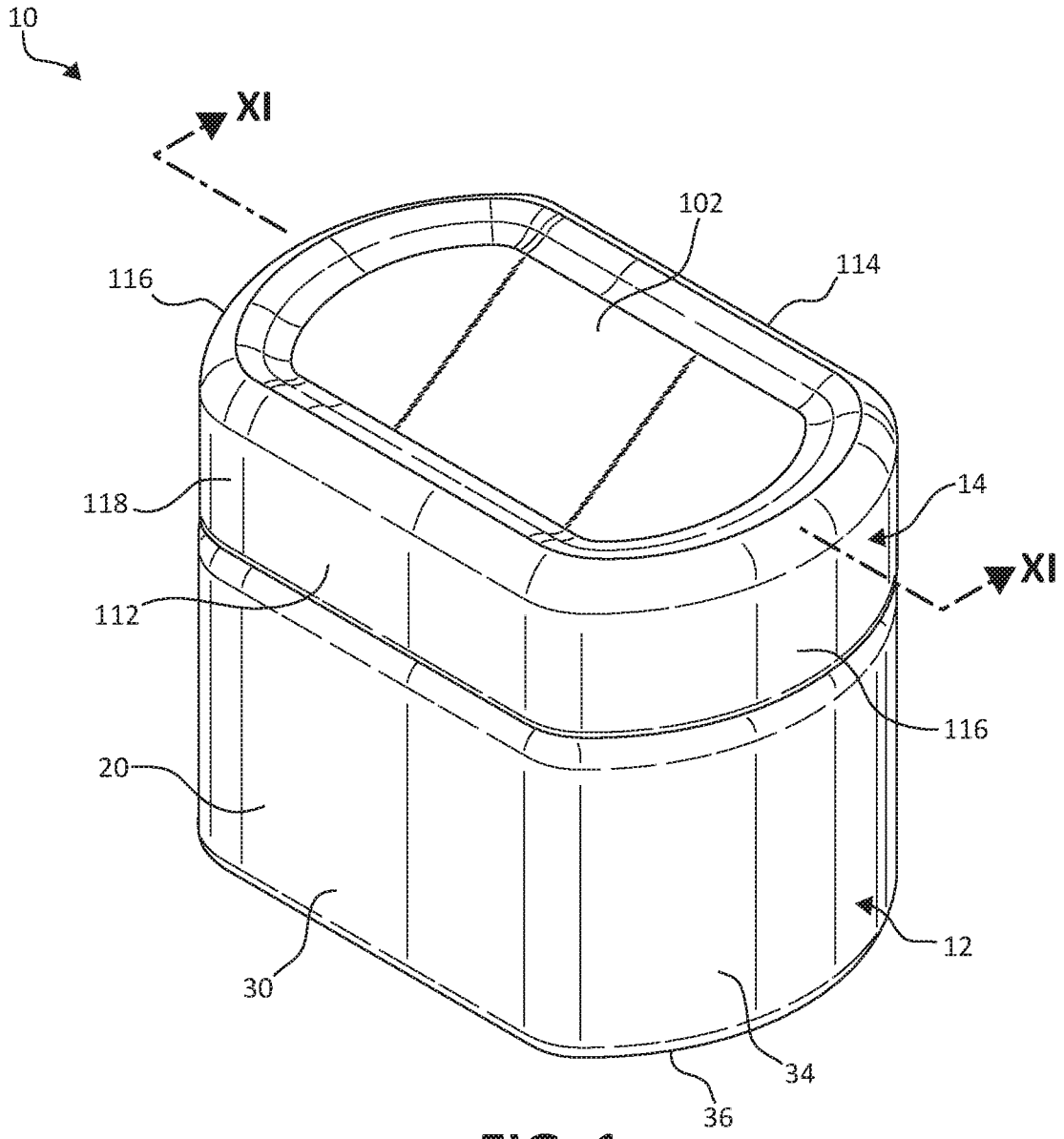
FIG. 1 is a front perspective view illustration of a container assembly, according to one embodiment of the present invention.
Figure 2:
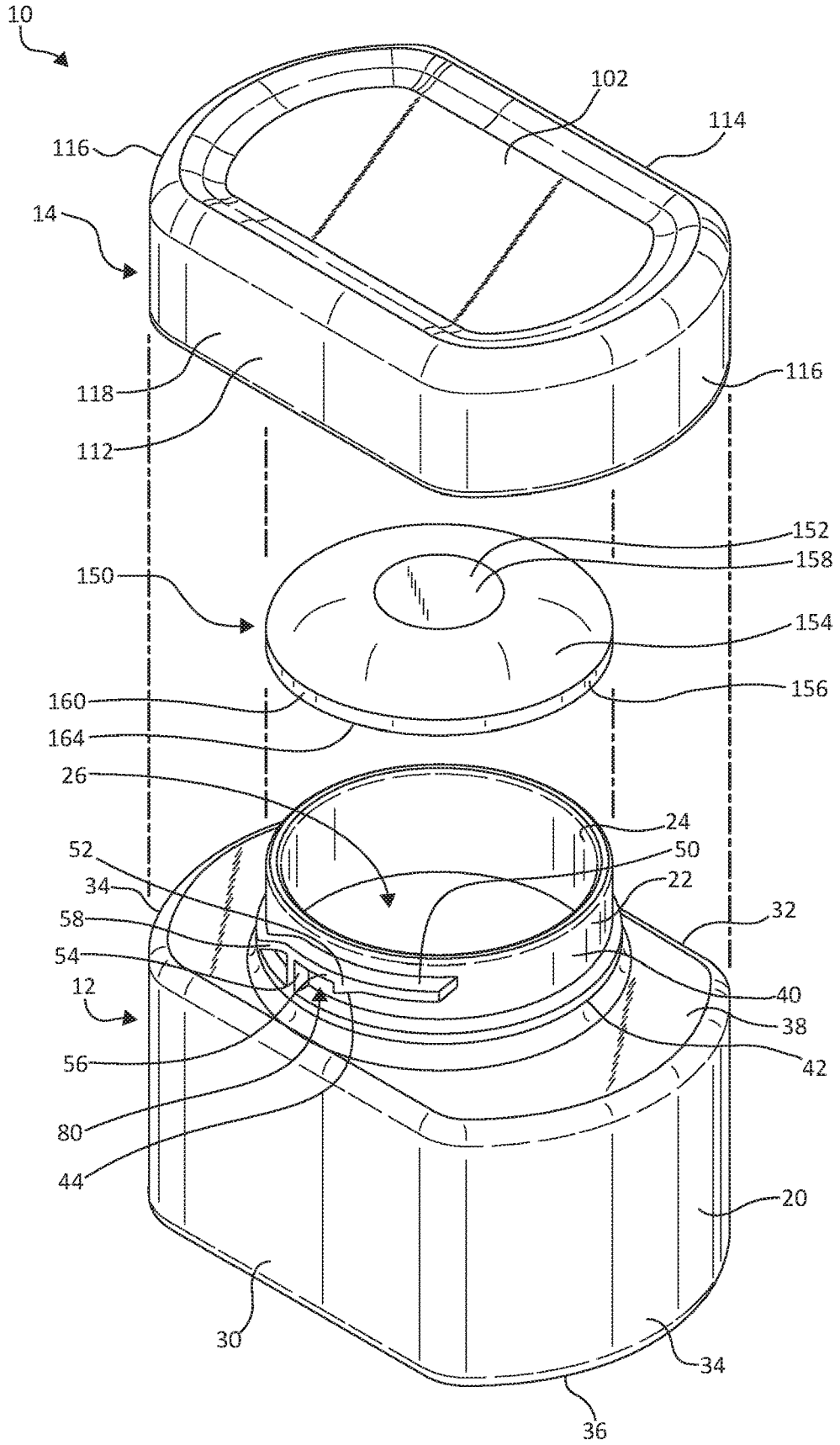
FIG. 2 is an exploded, front perspective view illustration of the container assembly of FIG. 1, according to one embodiment of the present invention.
Figure 3:
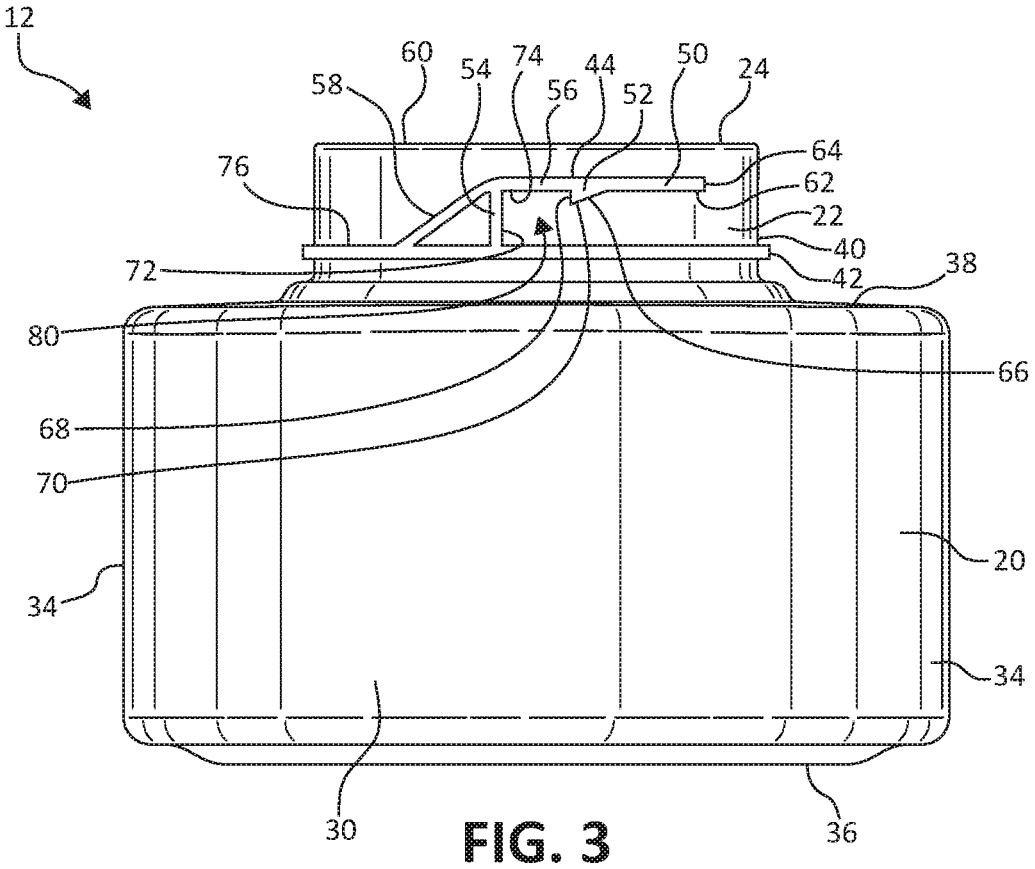
FIG. 3 is a front view illustration of a container of the container assembly of FIG. 1, according to one embodiment of the present invention.

Turning to the Figures, FIG. 1 illustrates a container assembly 10 including a container 12, such as a bottle, and a closure 14, such as a cap, selectively covering and locking to container 12. Additionally referring to the exploded view of FIG. 2 and the cross-sectional view of FIG. 3, container 12 includes body 20 and a neck 22 extending upwardly from a top of body 20 to define an open mouth 24 opposite body 20. Body 20 is formed in any suitable manner to form a storage chamber 26 therein for maintaining items 28 (see FIG. 10), such as vitamins or other pharmaceuticals or consumables. In one example, as shown in the included illustrations, body 20 includes a substantially planar front surface 30, a substantially planar rear surface 32 spaced from and opposite substantially planar front surface 30, curved sidewalls 34, a bottom wall 36, and a top wall 38. One of curved sidewalls 34 extends between substantially planar front surface 30 and substantially planar rear surface 32 in a convex manner opposite the other one of curved sidewalls 34. Bottom wall 36 extends between each of substantially planar front surface 30, substantially planar rear surface 32, and curved sidewalls 34 to entire cap a bottom of storage chamber 26. Top wall 38 extends between each of substantially planar front surface 30, substantially planar rear surface 32, and curved sidewalls 34 to cover at least a portion of a top of storage chamber 26 leading to neck 22. Other body 20 shapes and configurations, such as cylindrical or rectangular prims shapes, are also contemplated as will be apparent to those of skill in the art upon reading the present application.

Neck 22 extends away from body 20, for example, upwardly from top wall 38, in a substantially cylindrical form and includes a primary exterior surface 40, a rim 42, and at least two latch protrusions 44, in one example, two latch protrusions 44. Rim 42 extends radially outwardly and circumferentially around, in one embodiment, substantially continuously around, a lower portion of primary exterior surface 40 of neck 22. Rim 42 defines a top surface 76 facing upwardly. Rim 42 is configured to add rigidity to neck 22 and to serves as a stop for movement of closure 14 downwardly relative to container 12, as will be further described below. Each latch protrusion 44 extends outwardly from primary exterior surface 40 of neck 22, for example, a similar distance as rim 42 extends away from primary exterior surface 40 of neck 22. Each latch protrusion 44 is configured to selectively interact with features of closure 14 to selectively lock closure 14 to container 12 in a manner covering open mouth 24. In one example, each latch protrusion 44 is sized to extend along an arc defined by exterior surface 40 of neck 22 measuring at least 75° and, in one instance, measuring at least about 90° from end to end.

In one embodiment, two or more of latch protrusions 44 are each substantially identical such that the below description of one latch protrusion 44 is meant to describe each of the two or more latch protrusions 44. Latch protrusion 44 includes a rail 50, a ramp 52, a first stop 54, a second stop 56, and/or a brace protrusion 58, in one example. Rail 50 is circumferentially linear, meaning rail 50 extends along a portion of a circumference of neck 22 in a narrow and elongated manner. Rail 50 is spaced between rim 42 and a top edge 60 of neck 22 defined adjacent open mouth 24, for instance, to be closer to top edge 60 than rim 42. Rail 50 defines a bottom surface 62 facing rim 42. Rather than being continuous about an entire circumference of neck 22 like rim 42, in one example, rail 50 defines a leading end 64 positioned on a right side thereof and circumferentially extends away from, for example, leftward in the orientation of FIG. 3, to ramp 52. In one embodiment, rail 50 is the longest portion of latch protrusion 44 and/or is at least equal to or longer than each of ramp 52 and second stop 56. Ramp 52 defines a bottom surface 66 beginning immediately adjacent bottom surface 62 of rail 50 and angles downwardly and to the left before terminating at a trailing edge 68 of ramp 52, which, in one embodiment, extends substantially vertically from a lowest point 70 of ramp 52.

First stop 54 extends vertically from rim 42 to a location substantially even with bottom surface 62 of rail 50. First stop 54 defines a leading surface 72 facing ramp 52 and, in one example, extending substantially vertically upwardly from rim 42. In one embodiment, second stop 56 is circumferentially colinear with rail 50 defining a bottom stop surface 74 at a substantially even height with bottom surface 62 of rail 50.

In one embodiment, second stop 56 extends substantially continuously between ramp 52 and first stop 54. Second stop 56 and rail 50 are substantially similar in width and are circumferentially colinear in one embodiment being each positioned so bottom surface 62 of rail 50 is positioned a substantially identical distance away from either one or both of rim 42 and top edge 60 of neck 22 as compared to bottom stop surface 74 of second stop 56. A latch recess 80 is defined outside of exterior surface 40 of neck 22, between rim 42 and second stop 56, and between trailing edge 68 of ramp 52 and leading surface 72 of first stop 54. In one example, rail 50 is significantly longer than second stop 56, and in one instance, rail 50 is more than about 20% longer than second stop 56, and in another instance, rail 50 is more than about 50% longer than second stop 56.

In one embodiment, a brace protrusion 58 extends from a top of a trailing side of first stop 54 downwardly and to the left to rim 42. Brace protrusion 58 provides additional rigidity to first stop 54. In one embodiment, brace protraction 58 is eliminated.

The at least two latch protrusions 44 are, in one example, equally spaced about a circumference of neck 22. In one embodiment, only two latch protrusions 44 are included on container 12, and each of the two latch protrusions 44 is positioned substantially one hundred and eighty degrees offset from the other of the two latch protrusions 44. In one embodiment, where two latch protrusions 44 are included on neck 22, each latch protrusion 44 is substantially identical and is offset about 180° from the other of the two latch protrusions 44. In this example, leading end 64 of one latch protrusion 44 is positioned about half way around neck 22, or about 180°, from leading end 64 of the other one of latch protrusions with a similar correspondence being made between each part of one latch protrusion 44 as compared to the corresponding part of the other one of latch protrusions 44.

Figure 4:
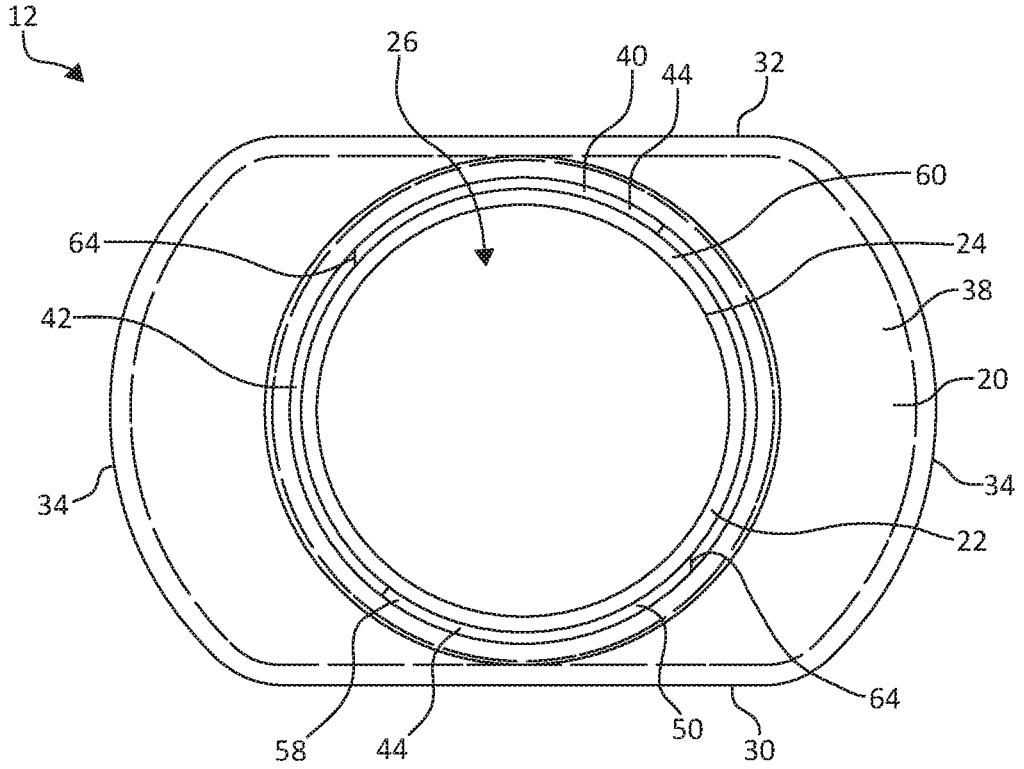
FIG. 4 is a top view illustration of the container of FIG. 3, according to one embodiment of the present invention.
Figure 5:
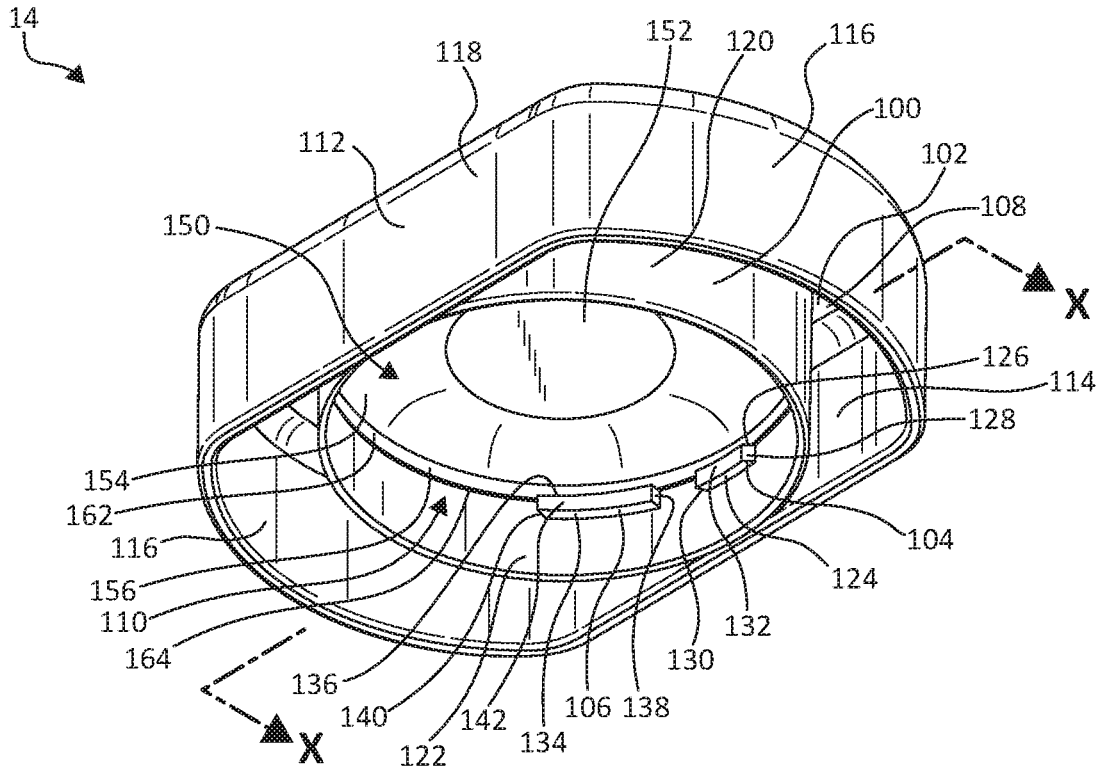
FIG. 5 is a bottom perspective view illustration of a closure of the container assembly of FIG. 1, according to one embodiment of the present invention.
Figure 6:
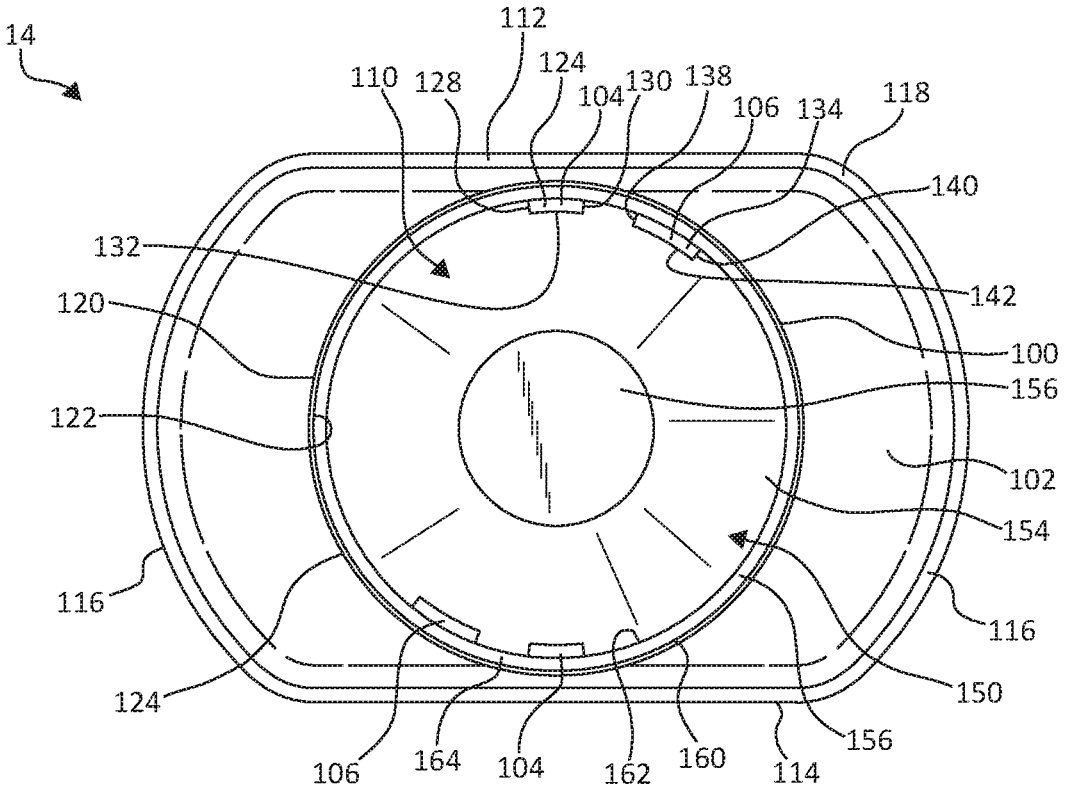
FIG. 6 is a bottom view illustration of the closure of FIG. 5, according to one embodiment of the present invention.
Figure 7:
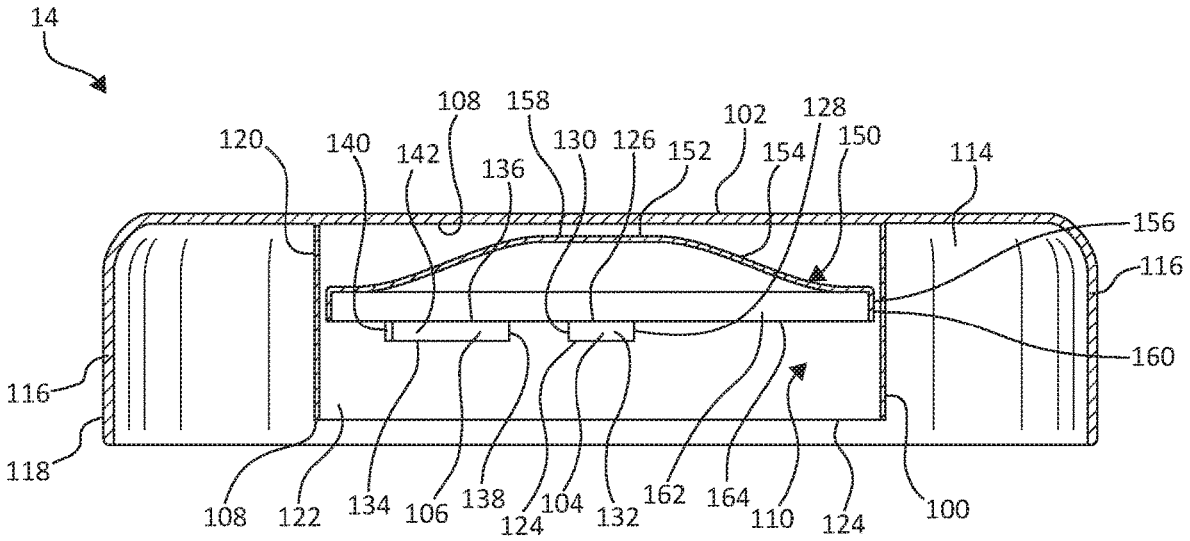
FIG. 7 is a cross-sectional illustration of the closure taken about the line X-X in FIG. 5, according to one embodiment of the present invention.

In one example, each latch protrusion 44 is positioned so that each latch recess 80 is substantially laterally centered relative to one of planar front surface 30 and planar rear surface 32 of container 12 as illustrated in FIG. 4, for example. In other embodiments, latch protrusions 44 may be otherwise positioned, such as with each latch recess 80 being substantially laterally centered relative to one of curved sidewalls 34 of container 12 or with each latch recess 80 being placed to align with the intersection of one of planar front surface 30 and planar rear surface 32 and one of curved sidewalls 34 or in any other suitable position around neck 22.

Closure 14 includes a cylindrical wall 100, a top closure wall 102, a first or latching lug 104, and a second or balance lug 106, in one embodiment. Cylindrical wall 100 is sized and shaped to extend around neck 22 of container 12. Top closure wall 102 extends over a top of cylindrical wall 100 capping a top of cylindrical wall 100 and forming a reception cavity 110 therein adjacent a bottom surface 108 of top closure wall 102. In one embodiment, top closure wall 102 is substantially similar in overall diameter as cylindrical wall 100.

In another embodiment, as illustrated in FIGS. 1, 2, and 5-8, top closure wall 102 extends beyond the outer diameter of cylindrical wall 100 in a desired shape, such as a substantially oval shape similar to a cross-sectional shape of container 12. In one example, a front closure wall 112, a rear closure wall 114 opposite front closure wall 112, and opposing closure sidewalls 116, which each extend between front closure wall 112 and rear closure wall 114, collectively extend downwardly from a perimeter of top closure wall 102 to define a perimeter depending wall grouping 118. As such, front closure wall 112, rear closure wall 114, and closure sidewalls 116 each extends downwardly from top closure wall 102 an identical distance where, in one example, the identical distance is further than a distance cylindrical wall 100 extends downwardly from top closure wall 102. In one example, perimeter depending wall grouping 118 collectively form closure 14 in an oblong shape defining a distance between front closure wall 112 and rear closure wall 114 that is sized for an adult to fairly easily grasp, and, in one instance, that is sized sufficiently large to be difficult for a small child to grasp.

Cylindrical wall 100 provides the coupling means of the closure for selectively coupling with container 12. Cylindrical wall 100 extends downwardly from top closure wall 102 to define an outside surface 120 facing radially outwardly from and an inside surface 122 facing a center of closure 14. Cylindrical wall 100 includes one pair lugs, including first lug 104 and second lug 106, for every latch protrusion 44 included on a corresponding container 12. More specifically, in one embodiment, each of first lug 104 and second lug 106 extends inwardly from inside surface 122 of cylindrical wall 100, for example, generally in the shape of a rectangular prism at a position spaced downwardly from top closure wall 102. First lug 104 defines a bottom surface 124, a top surface 126 opposite bottom surface 124, a leading edge 128 extending between bottom surface 124 and top surface 126, and a trailing edge 130 extending between bottom surface 124 and top surface 126 opposite leading edge 128. Leading edge 128 is positioned to be the first portion of the pair of lugs that interacts with latch protrusion 44 when closure 14 is coupled with container 12. First lug 104 is sized with a length measured between leading edge 128 and trailing edge 130 substantially similar to, but slightly smaller than a length of latch recess 80 of container 12, as will be further described below. First lug 104 further defines an inner surface 132 opposite inside surface 122 of cylindrical wall 100.

Second lug 106 is formed with a similar cross-section as first lug 104 but a different length, such as a longer length, in one embodiment. Second lug 106 defines a bottom surface 134, a top surface 136 opposite bottom surface 134, a leading edge 138 extending between bottom surface 134 and top surface 136, and a trailing edge 140 extending between bottom surface 134 and top surface 136 opposite leading edge 138. Leading edge 138 is positioned to be the first part of second lug 106 that interacts with latch protrusion 44 when closure 14 is coupled with container 12. Second lug 106 further defines an inner surface opposing inside surface 122 of cylindrical wall 100. In one embodiment, second lug 106 has a length, as measured between leading edge 138 and trailing edge 140, that is longer than a length of first lug 104, for example at least 30% longer than a length of first lug 104, to provide added stability to closure 14 to container 12 interaction.

In one example, each of first lug 104 and section lug 106 are positioned on inside surface 122 of cylinder wall 100 at a similar distance away from each of bottom surface 108 of top closure wall 102 and from a bottom edge of cylindrical wall 100. More specifically, in one embodiment, each of top surface 126 of first lug 104 and top surface 136 of second lug 106 are positioned a similar distance away from each of bottom surface 108 of top closure wall 102 and from a bottom edge of cylindrical wall 100. In one embodiment, trailing edge 140 of first lug 104 is spaced from leading edge 138 of second lug 106 a distance substantially identical to a circumferential length of ramp 52.

Closure 14 additionally includes a spring member 150 configured to facilitate selectively locking closure 14 to container 12. In one embodiment, spring member 150 is generally circular defining a top panel 152, a dome panel 154, a skirt 156. Top panel 152 is substantially planar defining a top surface 158. Dome panel 154 extends radially outwardly and curvilinearly downwardly from a perimeter of top panel 152 in all directions such that spring member 150 is formed in a largely domed shape. Skirt 156 extends downwardly from an outer perimeter of dome panel in a downward manner to a bottom edge 164 thereof, defining an exterior facing surface 160 and an interior surface 162 facing a center of spring member 150.

Referring primarily to FIGS. 2 and 5-7, spring member 150 is placed within reception cavity 110 of closure 14. More particularly, in one embodiment, spring member 150 is placed with top surface 158 of top panel 152 facing and/or sitting immediately adjacent bottom surface 108 of top closure wall 102 within reception cavity 110. Exterior facing surface 160 of skirt 156 is placed to fit immediately adjacent and facing inside surface 122 of cylindrical wall 100. Spring member 150 is pushed into cylindrical wall 100 causing slight deformation of spring member 150 so that spring member 150 clears all pairs of lugs, that is first lug 104 and second lug 106 pairs, and is maintained in a space between top closure wall 102 and top surface 126 of first lug 104 and top surface 136 of second lug 106. In this position, spring member 150 is held in place via interaction between bottom edge 164 of spring member 150 and top surfaces 126 and 136 of first and second lugs 104 and 106, respectively. In one embodiment, the space between top closure wall 102 and top surface 126 of first lug 104 and second lug 106 is slightly larger than a height of spring member 150 such that spring member 150 has some freedom of vertical movement within the space. Bottom edge 164 of spring member 150 selectively interfaces with each of first lugs 104 and second lugs 106 to maintain spring member 150 within the confines of cylindrical wall 100. Spring member 150 is configured to selectively bias or otherwise push neck 22 of container 12 downwardly relative to closure 14.

Closure 14 is placed on and manipulated to selectively lock with container 12. In one embodiment, closure 14 is rotated to be offset from container 12 between about 45° and about 90°, which misaligns each pair of lugs 104/106 with any of latch protrusions 44 on neck 22 of container 12. Referring to the linear representations of FIGS. 9A-9E depicting a front half of neck 22 of container 12 and showing progressive movement of first lug 104 and second lug 106 relative to neck 22 in view of the locked position of closure 14 in FIG. 8, closure 14 is rotated in a clockwise manner relative to neck 22 of container 12 moving leading edge 128 into contact with leading end 64 of rail 50 of latch protrusion 44 as shown in FIG. 9A. Further movement of closure 14 in a clockwise and slightly downward manner as generally indicated by arrow "C" in FIG. 9A, causes first lug 104 and second lug 16 to move downwardly below rail 50 as illustrated in FIG. 9B. In one embodiment, leading edge 128 of first lug 104 is rounded and/or tapered slightly along bottom surface 124 thereof allowing first lug 104 to more easily transition from being substantially in line with rail 50 to a position below rail 50.

As illustrated in FIG. 9B, rail 50 extends in an elongated manner from ramp 52 to leading end 64 such that bottom surface 62 of rail 50 simultaneously interacts with both top surface 126 of first lug 104 and top surface 136 of second lug 106. The dual lug interaction, that is, sequenced and/or simultaneous interaction between first lugs 104 and second lugs 106, with rail 50 introduces more points of contact between closure 14 and container 12, and thereby, provides a more stable and level closure 14 to container 12 interaction as it decreases tilt or rotation of closure 14 relative to container 12 that would likely be introduced if only a single lug interacted with rail 50 or similar. The additional stability of each pair of lugs 104/106 and latch protrusion 44 interaction allows for fewer pairs of lugs 104/106 and fewer latch protrusions 44 to be included container assembly 10 while still providing a stable and relatively easily-to-use closure 14 as compared to prior art closures, which typically include more than two points of locking engagement between a container and its closure.

Figure 9A:
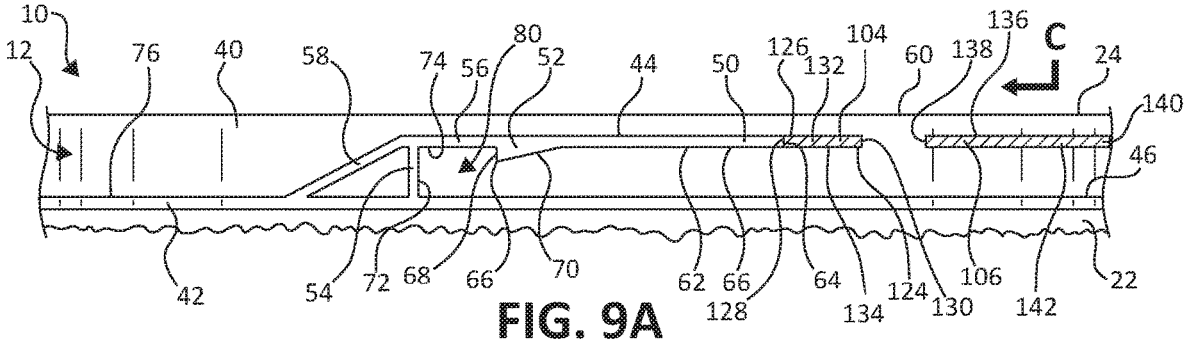
FIG. 9A-9D illustrate an enlarged, linear representation of a neck of the container superimposed with hatched locking lugs of the closure of the container assembly through a progression of positions during clockwise movement of the closure about the neck of the container when locking the closure to the container, according to one embodiment of the present invention.
Figure 9B:
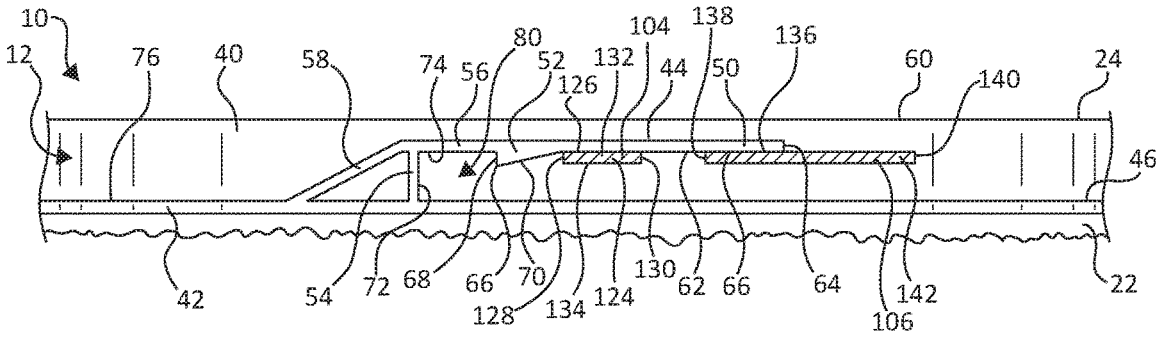
Figure 9C:
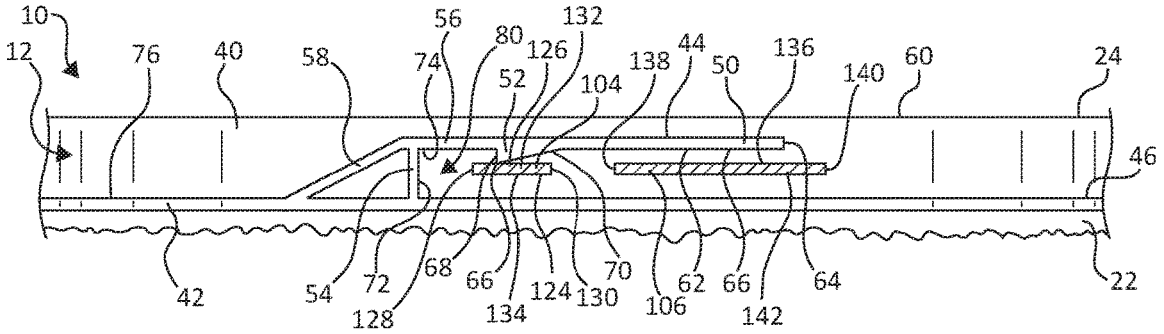

Continued movement of closure 14 in a clockwise movement relative to container 12 to the position shown in FIG. 9C moves leading edge 128 of first lug 104 into contact with ramp 52, more specifically, bottom surface 62 of ramp 52. The taper of bottom surface 62 of ramp 52 induces a downward vertical force to closure from the clockwise rotation of closure 14. In one example, downward movement of first lug 104 induces movement of closure 14 further down onto container 12, which induces compression of spring member 150 in a manner overcoming the initial bias of spring member 150. The bias of spring member 150 pulls upwardly on first lug 104 and second lug 106 holding the same in tight contact with latch protrusion 44.

Figure 9D:
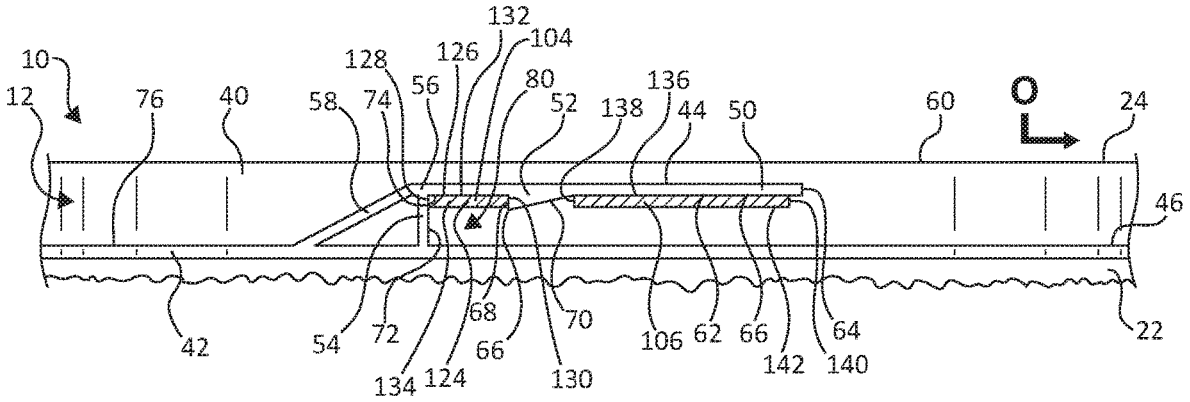

FIG. 9D is the result of continued clockwise rotation of closure 14 from the position shown in FIG. 9C. This continued rotational movement moves first lug 104 past the lowest point 70 of ramp 52, and the bias of spring member 150 pulls closure 14 upwardly away from container 12, consequently, pulling first lug 104 into latch recess 80 and mating top surface 126 of first lug 104 with bottom stop surface 74 of second stop 56. In this position, top surface 136 of second lug 106 is also pulled into direct contact with bottom surface 62 of rail 50, that is, a bottom surface of latch protrusion 44 on an opposite side of ramp 52 as compared to first lug 104.

The dual lug interaction with latch protrusion 44, namely, first lug 104 with second stop 56 and second lug 106 with rail 50, introduces two elongated points of contact between closure 14 and container 12, thereby, providing a more stable and level closure 14 to container 12 interaction by decreasing tilt or rotation about a non-vertical axis of closure 14 relative to container 12 that would likely be introduced if only a single lug-to-protrusion interaction and/or similar engagement between closure 14 and container 12 were present. The additional stability of each pair of lugs 104/106 and latch protrusion 44 interaction allows for fewer pairs of lugs 104/106 and fewer latch protrusions 44 to be included container assembly 10 while still providing a stable and easily to use closure 14 as compared to prior art closures, which typically include more than two points of locking engagement between a container and its closure.

Figure 8:
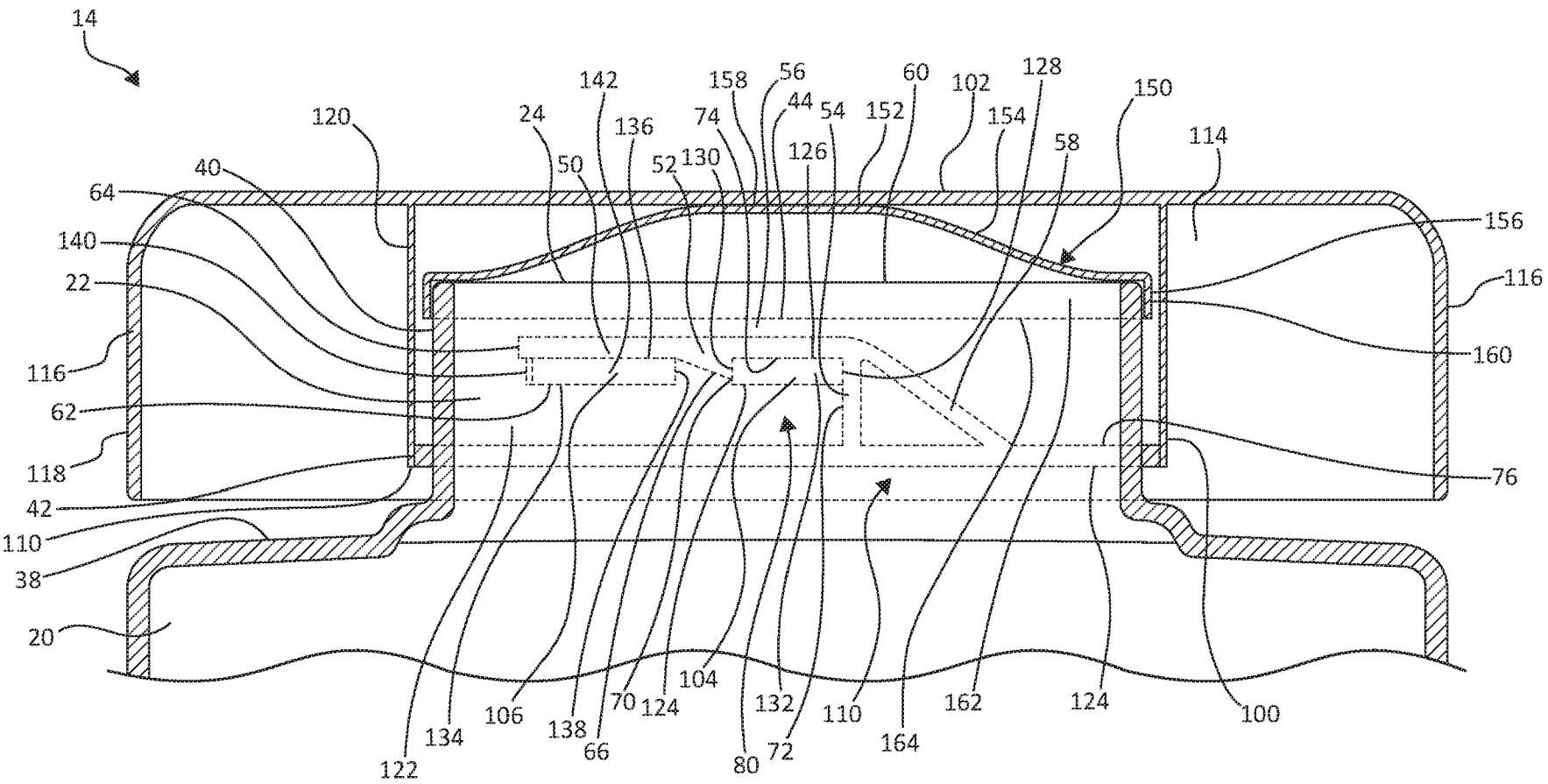
FIG. 8 is a cross-sectional view illustration of the container assembly taken about the line XI-XI in FIG. 1, according to one embodiment of the present invention.

The positioning shown in FIGS. 8 and 9D is the locked closure position between container 12 and closure 14, which matches the illustration of FIG. 1. In one example, in the locked closure position, a substantial entirety and, in one instance, an entirety of elongated top surface 136 of second lug 106 is in full and continuous contact with bottom surface 62 of rail 50. This elongated dimension of contact between rail 50 and second lug 106 further promotes stability and substantially leveled, non-tilting interaction between container 12 and closure 14. The substantially leveled interaction aligns latch protrusion 44 and lugs 104 and 106 in a manner making the container 12-to-closure 14 coupling substantially easier. In addition, spring member 150 holds first lug 104 and second lug 106 tightly in their locked position by biasing closure 14 with an upward force pulling first lug 104 and second lug 106 tightly against bottom stop surface 74 of second stop 56. Undesired continued rotation of closure 14 relative to container 12 is substantially prevented via interaction between leading edge 128 of first lug 104 and leading surface 72 of first stop 54 and between trailing edge 130 of first lug 104 and trailing edge 68 of ramp 52.

Figure 9E:
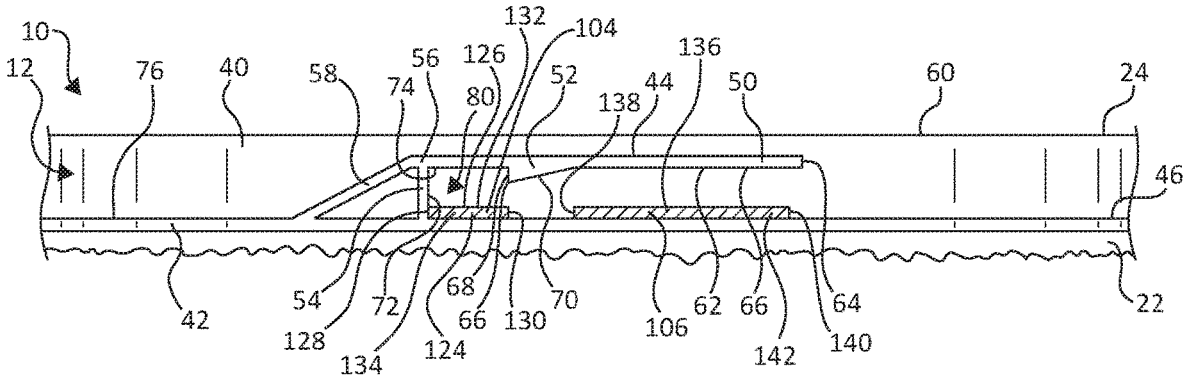
FIG. 9E shows an enlarged linear representation of a neck of the container superimposed with hatched locking lugs of the closure of the container assembly upon pressing down on the closure to unlock the closure from the container, according to one embodiment of the present invention.

In order to release closure 14 from its locked position with container 12, bias of spring member 150 is overcome by a user applying a downward force and subsequent counterclockwise rotation to closure 14 relative to container 12, as generally indicated by arrow "O" in FIG. 9D to move toward the positioning illustrated in FIG. 9E. Downward force on closure 14 moves first lug 104 and second lug 106 down below lowest point 70 of ramp 52, but not further than a top surface 76 of rim 42, which serves as a stop on such movement as generally illustrated in FIG. 9E. Counterclockwise rotation of closure 14 moves first lug 104 back past ramp 52 following a reverse progression, for example, through the position of FIG. 9E, to the position of FIG. 9C, to the position of FIG. 9B, and finally, to the position of FIG. 9 in which both first lug 104 and second lug 106 are placed out of alignment with any latch protrusion 44. When first lug 104 and second lug 106 are misaligned with latch protrusion 44, closure is readily lifted upwardly and away from container 12, separating container 12 and closure 14.

The amount of rotation needed to transition from the position of FIG. 9E back to the position of FIG. 9A is dependent upon the length rail 50 extends away from ramp 52 to leading end 64 of rail 50. In one example, rail 50 is of a sufficient length requiring a turn of closure 14 equal to between about 45° and about 90°, for example, a turn of more than about 60°, to release closure 14 from container 12, more specifically, to release closure 14 from latch protrusion 44. In one embodiment, the amount of rotation to secure closure 14 to container 12 via latch protrusion 44 is substantially equal to the rotation needed to release closure 14 from container 12. A larger degree of turn to release closure 14 from container 12 assists in making closure 14 a child-resistance closure 14. In one example, a container assembly 10 with only two pairs of lugs 104/106 and only two corresponding latch protrusions 44 each having a sufficiently long rail 50 requires at least about a 60° rotation, for example, at least about an 80° rotation, more specifically, about a 90° rotation, to lock and unlock closure 14 from container 12, providing a child-resistant closure.

Figure 10:
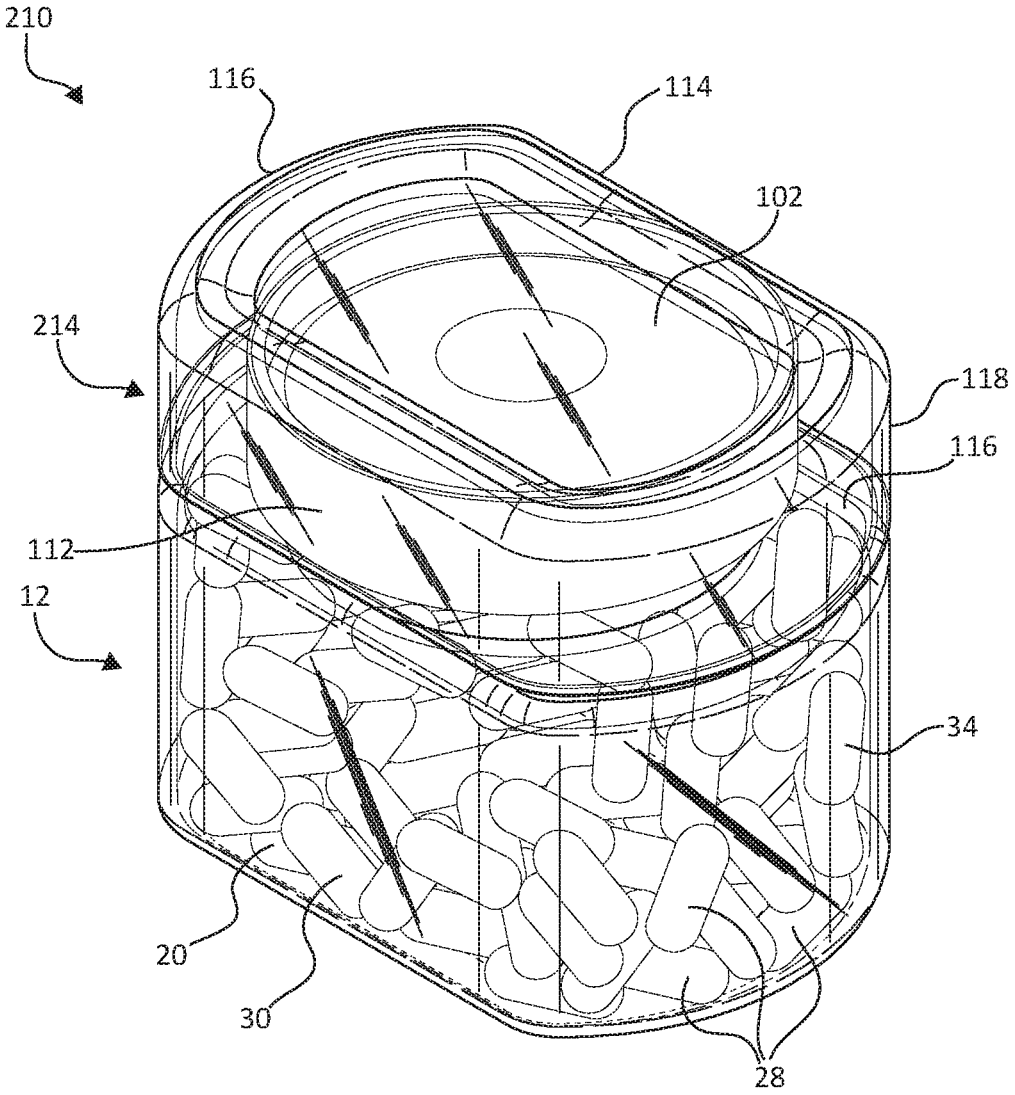
FIG. 10 is a front perspective view illustration of a container assembly, according to one embodiment of the present invention.
Figure 11:
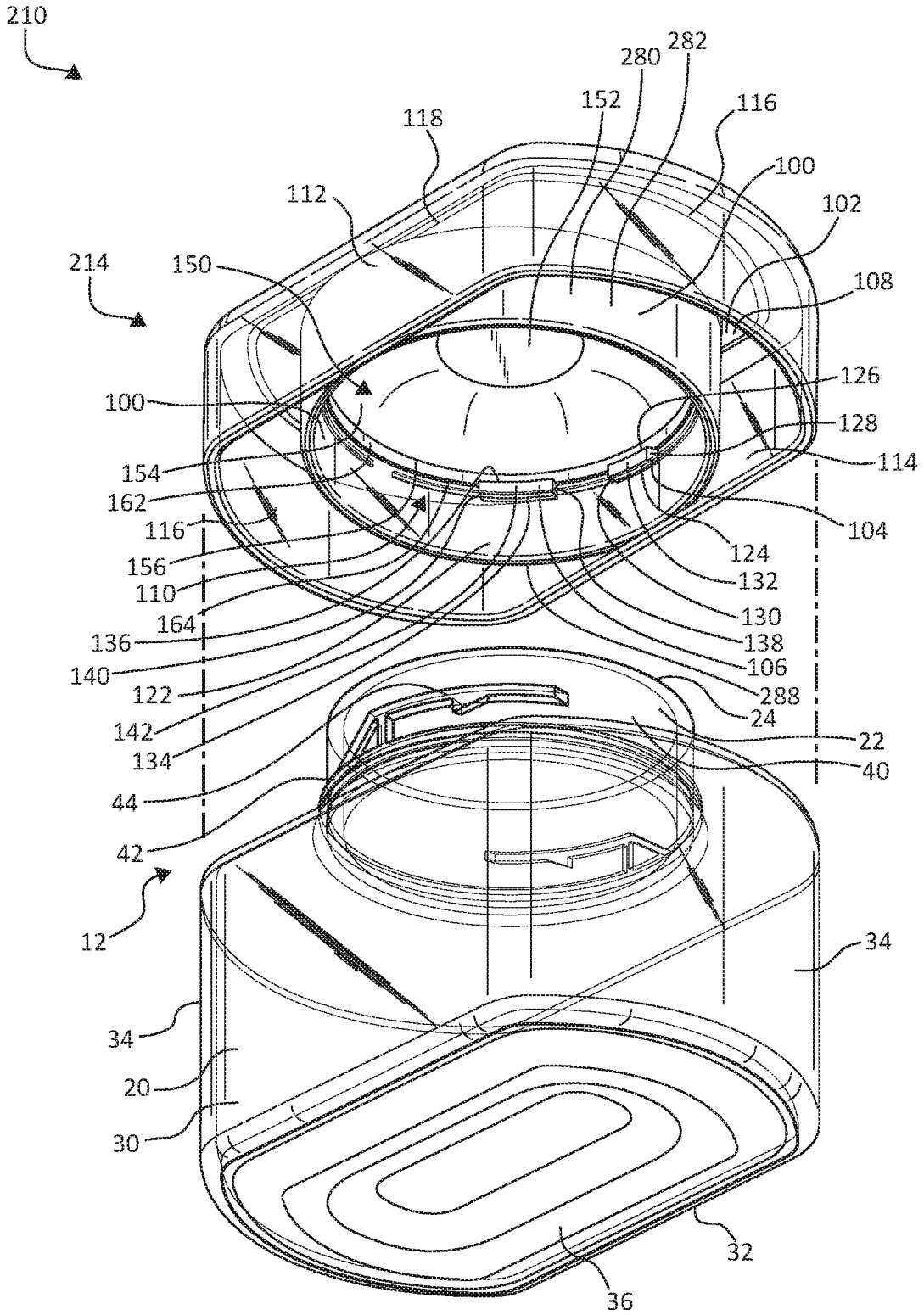
FIG. 11 is an exploded, front perspective view illustration of the container assembly of FIG. 10, according to one embodiment of the present invention.
Figure 12:
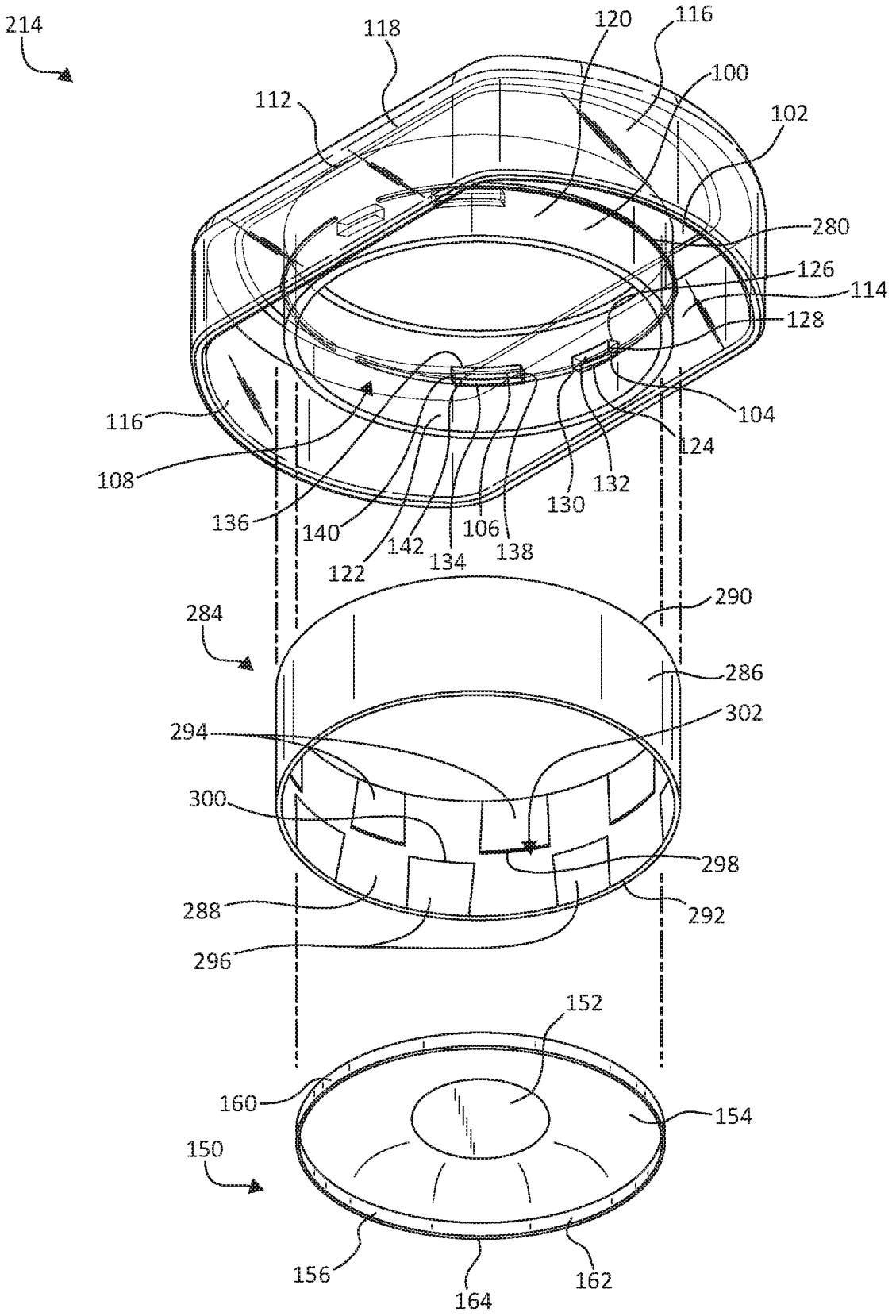
FIG. 12 is an exploded, bottom perspective view illustration of a closure of the container assembly of FIG. 10, according to one embodiment of the present invention.

FIGS. 10 and 11 illustrate one embodiment of a container assembly 210 having similarities to container assembly 10, such that like reference numerals depict similar parts and features. Container assembly 210 includes container 12 and a closure 214. In one embodiment, container 12 of container assembly 210 is substantially as described above for container assembly 10, but illustrated in FIGS. 10 and 11 as transparent versus opaque.

Closure 214 is largely similar to closure 14 described above, except for the specific difference recited herein, with like reference numeral depicting like parts and features. In FIGS. 10-13, closure 214 is depicted as being transparent, but other material types and/or materials having differing levels of opaqueness are also contemplated. In one embodiment, closure 214 includes a ring 284, such as distinctly colored or otherwise opaque ring 284, surrounding cylindrical wall 100 producing an esthetically interesting appearance and/or color identifier to container assembly 210.

As part of closure 214, cylindrical wall 100 includes a closure rib 280 continuously or non-continuously extending circumferentially around outside surface 120 of cylindrical wall 100. Closure rib 280 is configured to snap lock with ring 284, which includes corresponding features for receiving and locking ring 284 to cylindrical wall 100 and closure rib 280. In one embodiment, ring 284 is annular and defines an outside surface 286 facing radially outwardly from a center of ring 284 and an inside surface 288 opposite outside surface 286 and facing a center of ring 284. Ring 284 additionally defines a top edge 290 and a bottom edge 292 opposite top edge 290.

In one example, ring 284 includes means for coupling with cylindrical wall 100 in the form of top protruding ramps 294 and bottom protruding ramps 296. Referring primarily to the exploded view of FIG. 12, in one embodiment, a plurality of top protruding ramps 294 extend from near top edge 290 just less than halfway toward bottom edge 292 in reverse taper, such that each top protruding ramp 294 gradually extends farther and farther radially inwardly from inside surface 288 as it approaches a center of ring 284 from near top edge 290. Each top protruding ramp 294 terminates in a bottom edge 298 opposite top edge 290 of ring 284. Conversely, in one embodiment, a plurality of bottom protruding ramps 296 extend from near bottom edge 292 just less than halfway toward top edge 290 in a reverse tapered manner such that each bottom protruding ramp 296 gradually extends farther and farther radially inwardly away from inside surface 288 as it approaches a center of ring 284 from near bottom edge 292. In one example, since neither top protruding ramps 294 or bottom protruding ramp 296 extend to a center of rig 284 or other common point of ring 284, a circumferential gap 302 is define between the plurality of top protruding ramps 294 and the plurality of bottom protruding ramps 296. Each bottom protruding ramp 296 terminates in a top edge 300 opposite bottom edge 292 of ring 284.

Figure 13:
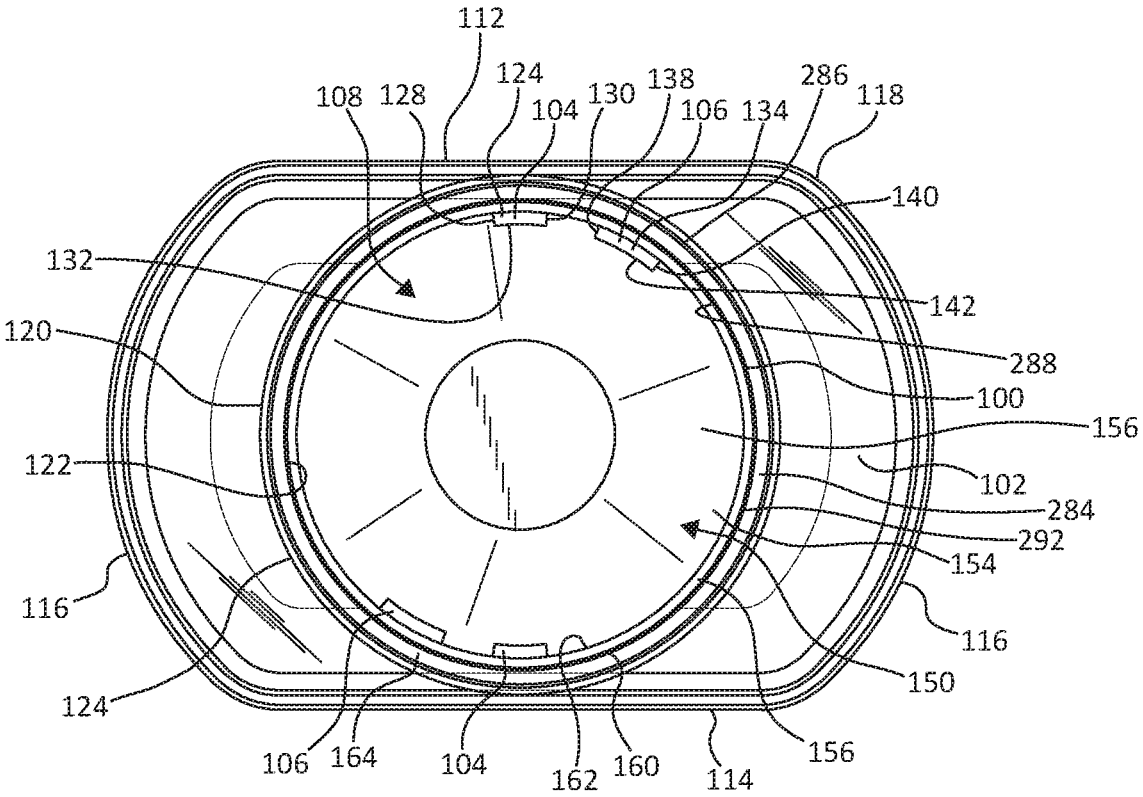
FIG. 13 is a bottom view illustration of the closure of FIG. 12, according to one embodiment of the present invention.

Ring 284 slides around cylinder wall 100 and snaps onto closure 14 via closure rib 280. More specifically, in one embodiment, as ring 294 is slid onto cylinder wall 100, top protruding ramps 294 slide along closure rib 280 slightly deforming ring 284 outwardly until ring 284 is slid into position around cylinder wall 100 by closure rib 280 over a bottom end of top protruding ramps 294 moving closure rib 280 into gap 302. The raised nature of top protruding ramps 294 and bottom protruding ramps 296 interact with either side of closure rib 280 coupling ring 284 with a remainder of closure 14, that is around cylinder wall 100, for example, as shown in FIG. 13. In one example, other than inclusion of ring 284, closure 214 includes spring member 150 and couples to container 12 in a manner as described above for closure 14, as will be apparent to those of skill in the art upon reading the present application.

According to embodiments described above, a container assembly according to the present invention provides for a two or more latch interfaces between a closure and a container having features configured to limit tilt of the closure relative to the container and utilize a large angle of rotation for coupling and removing the closure from the container. In one example, the combination of features of the closure of the container assembly results in a child-resistant closure. In one embodiment, the closure utilizes two lugs of similar vertical position on closure, that is of similar location as measured downwardly from a top wall of the closure, and an elongated rail of the container to selectively lock the closure to the container.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A container assembly comprising:

a container including a body and a neck, wherein:

the body defines a storage chamber, the neck extends away from the body and defines an open mouth providing access to the storage chamber, and the neck defines an exterior surface and at least two latching protrusions extending radially outwardly from the exterior surface; and a closure including a top wall, a cylindrical wall extending downwardly from the top wall, a first lug extending radially inwardly from the cylindrical wall, and a second lug extending radially inwardly from the cylindrical wall, wherein a top surface of the first lug and a top surface of the second lug are each positioned a substantially identical distance away from the top wall and the first lug and the second lug are each configured to selectively lock with a common one of the at least two latching protrusions at the same time while the closure is in a latched position relative to the container;

wherein the closure is configured to be rotated at least 60° from the latched position to clear the first lug and the second lug from the common one of the at least two latch mechanisms and remove the closure from the container.

2. The container assembly of claim 1, wherein:

the first lug and the second lug collectively form a pair of lugs, the container assembly includes two or more pairs of lugs, and each of the two or more pairs of lugs interfaces with a different one of the at least two latching protrusions.

3. A container assembly comprising:

a container including a body and a neck, wherein:

the body defines a storage chamber, the neck extends away from the body and defines an open mouth providing access to the storage chamber, and the neck defines an exterior surface and at least two latching protrusions extending radially outwardly from the exterior surface; and a closure including a top wall, a cylindrical wall extending downwardly from the top wall, a first lug extending radially inwardly from the cylindrical wall, and a second lug extending radially inwardly from the cylindrical wall, wherein a top surface of the first lug and a top surface of the second lug are each positioned a substantially identical distance away from the top wall and the first lug and the second lug are each configured to selectively lock with a common one of the at least two latching protrusions at the same time while the closure is in a latched position relative to the container;

wherein the closure requires a closure rotation relative to the container of at least 60° from a latched position to clear the first lug and the second lug from the common one of the at least two latch mechanisms to remove the closure from the container due to the circumferential length of the common one of the at least two latch mechanisms.

4. A container assembly comprising:

a container including a body and a neck, wherein:

the body defines a storage chamber, the neck extends away from the body and defines an open mouth providing access to the storage chamber, and the neck defines an exterior surface and at least two latching protrusions extending radially outwardly from the exterior surface; and a closure including a top wall, a cylindrical wall extending downwardly from the top wall, a first lug extending radially inwardly from the cylindrical wall, and a second lug extending radially inwardly from the cylindrical wall, wherein a top surface of the first lug and a top surface of the second lug are each positioned a substantially identical distance away from the top wall and the first lug and the second lug are each configured to selectively lock with a common one of the at least two latching protrusions;

wherein:

the neck defines a top edge; and the common one of the at least two latch mechanisms of the container includes:

a first stop protruding from the exterior surface of the neck to define a leading surface with a substantially vertically orientation when the container is in an upright position;

a second stop protruding from the exterior surface of the neck to define a bottom stop surface extending circumferentially along a segment of the exterior surface of the neck and spaced a first distance from the top edge of the neck;

a ramp protruding from the exterior surface of the neck adjacent to and extending below the second stop, the ramp tapering upwardly as it circumferentially extends away from the second stop, and a rail protruding from the exterior surface of the neck in a circumferentially linear manner from the ramp and away from the second stop, the rail defining a bottom rail surface that is spaced the first distance from the top edge of the neck.

5. The container assembly of claim 4, wherein when the closure is locked with the container, the top surface of the first lug directly interfaces with the bottom stop surface and the top surface of the second lug directly interfaces with the bottom rail surface.

6. The container assembly of claim 5, wherein during uncoupling of the closure from the container, both the top surface of the first lug and the top surface of the second lug directly interface with the bottom rail surface.

7. The container assembly of claim 6, wherein:

the closure includes a spring member maintained within the cylindrical wall between the top wall and the first lug, and wherein during uncoupling of the closure from the container, both the top surface of the first lug and the top surface of the second lug are selectively held in contact with the bottom rail surface via the spring member until at least one of the first lug and the second lug is rotated out of alignment with the rail.

8. The container assembly of claim 5, wherein when the closure is locked with the container, the first lug and the second lug are position adjacent to opposing sides of the ramp.

9. The container assembly of claim 5, wherein:

the closure includes a spring member maintained within the cylindrical wall between the top wall and the first lug, and when the closure is locked with the container, the first lug is maintained in the latch recess between the ramp and the first stop and the spring member biases the first lug into contact with the second stop.

10. The container assembly of claim 4, wherein the common one of the at least two latch mechanisms extends across a 90° arc of an exterior surface of the neck.

11. The container assembly of claim 10, wherein:

the common one of the at least two latch mechanisms is a first latch mechanism, and the container assembly further comprises a second latch mechanism extending across a different 90° arc of an outside surface of the neck opposite the 90° arc of the exterior surface of the neck occupied by the first latch mechanism.

12. A container assembly comprising:

a container including a body and a neck, wherein:

the body defines a storage chamber, the neck extends away from the body and defines an open mouth providing access to the storage chamber, and the neck defines an exterior surface and at least two latching protrusions extending radially outwardly from the exterior surface; and a closure including a top wall, a cylindrical wall extending downwardly from the top wall, a first lug extending radially inwardly from the cylindrical wall, and a second lug extending radially inwardly from the cylindrical wall, wherein a top surface of the first lug and a top surface of the second lug are each positioned a substantially identical distance away from the top wall and the first lug and the second lug are each configured to selectively lock with a common one of the at least two latching protrusions at the same time while the closure is in a latched position relative to the container; and a rim protruding about a circumference of the exterior surface of the neck and intersecting the latching mechanism, wherein the rim extends substantially parallel to a rail.

13. The container assembly of claim 12, further comprising a ring member secured about an exterior surface of the cylindrical wall.

14. A container assembly comprising:

a container including a body and a neck, wherein:

the body defines a storage chamber, the neck extends away from the body and defines an open mouth providing access to the storage chamber, and the neck defines an exterior surface and at least two latching protrusions extending radially outwardly from the exterior surface; and a closure including a top wall, a cylindrical wall extending downwardly from the top wall, a first lug extending radially inwardly from the cylindrical wall, and a second lug extending radially inwardly from the cylindrical wall, wherein a top surface of the first lug and a top surface of the second lug are each positioned a substantially identical distance away from the top wall and the first lug and the second lug are each configured to selectively lock with a common one of the at least two latching protrusions;

wherein:

the neck defines a top edge; and the common one of the at least two latch mechanisms of the container includes:

a stop protruding from the exterior surface of the neck to define a bottom stop surface extending circumferentially along a segment of the exterior surface of the neck and spaced a first distance from the top edge;

a ramp protruding from the exterior surface of the neck adjacent to and extending below the stop, the ramp tapering upwardly as it circumferentially extends away from the stop, and a rail protruding from the exterior surface of the neck in a circumferentially linear manner from the ramp and away from the stop, the rail defining a bottom rail surface that is spaced the first distance from the top edge of the neck.

15. The container assembly of claim 14, wherein when closure is locked with container, the top surface of the first lug directly interfaces with the bottom stop surface and the top surface of the second lug directly interfaces with the bottom rail surface.

16. The container assembly of claim 15, wherein:

the closure includes a spring member maintained within the cylindrical wall between the top wall and the first lug, and when the closure is locked with the container, the top surface of the first lug is maintained in contact with the bottom stop surface and the top surface of the second lug is maintained in contact with the bottom rail surface via biasing of the spring member against the neck of the container.

17. A container assembly comprising:

a container including a body and a neck, wherein:

the neck extends away from the body and defines an open mouth providing access to a storage chamber defined within the body, the neck defines an exterior surface and a latching protrusion extending radially outwardly from the exterior surface, the latching protrusion includes a stop, a ramp adjacent the stop and tapering away from the stop, and a circumferentially linear rail extending from an end of the ramp opposite the stop away from the stop, and the circumferentially linear rail defines a bottom rail surface; and a closure including a top wall, a cylindrical wall extending downwardly from the top wall, a latching lug extending radially inwardly from the cylindrical wall, and a balance lug extending radially inwardly from the cylindrical wall and circumferentially spaced from the latching lug, wherein during rotation of the closure relative to the container to secure the closure to the container, the latching lug and the balance lug both simultaneously interface with the bottom rail surface of the circumferentially linear rail.

18. The container assembly of claim 17, wherein a top surface of the latching lug and a top surface of the balance lug are each positioned a substantially identical distance away from the top wall such that the latching lug and the balance lug are each configured to selectively lock with the latching protrusion.

19. The container assembly of claim 18, wherein:

the closure includes a spring member interfacing with the neck of the container to bias the latching lug and the balance lug into direct contact with the latching protrusion, the stop defines a bottom stop surface positioned a distance away from a top edge of the neck that is substantially identical to a distance the bottom rail surface is positioned from the top edge of the neck, and when the closure is in a locked position relative to the container, the spring member maintains the latching lug in contact with the bottom stop surface and the balance lug in contact with the bottom rail surface.

* * * * *